United States Patent [19]

Welsh

[11] 4,373,493

[45] Feb. 15, 1983

[54] METHOD AND APPARATUS FOR UTILIZING GASEOUS AND LIQUID FUELS IN AN INTERNAL COMBUSTION ENGINE

[76] Inventor: James W. Welsh, 75 Templar Way, Summit, N.J. 07901

[21] Appl. No.: 160,501

[22] Filed: Jun. 18, 1980

[51] Int. Cl.[3] ..... F02M 21/02; F02M 13/08

[52] U.S. Cl. ..... 123/525; 123/576

[58] Field of Search ..... 123/526, 576, 525, 577, 123/575, 198 D, 198 DB

[56] References Cited

U.S. PATENT DOCUMENTS

| | | | |
|---|---|---|---|
| 1,397,780 | 11/1921 | Pohl | 48/180 C |
| 1,931,698 | 10/1933 | Holzapfel | 123/575 |
| 1,954,968 | 4/1934 | Waters | 123/575 |
| 2,011,243 | 8/1935 | Griswold | 123/198 DB |
| 2,143,194 | 1/1939 | Holzapfel | 48/180 C |
| 2,339,988 | 1/1944 | Gerson | 123/525 |
| 2,381,304 | 8/1945 | Merrill | 123/525 |
| 2,454,222 | 11/1948 | Shepherd | 123/525 |
| 2,690,167 | 9/1954 | Moulton | 123/526 |
| 2,708,916 | 5/1955 | Davids | 123/526 |
| 3,710,770 | 1/1973 | Newkirk | 123/575 |
| 3,977,384 | 8/1976 | Jahn | 123/198 D |
| 4,068,639 | 1/1978 | Cook | 123/525 |
| 4,227,497 | 10/1980 | Mathieson | 123/525 |

FOREIGN PATENT DOCUMENTS

| | | | |
|---|---|---|---|
| 866732 | 4/1941 | France | 48/180 C |

*Primary Examiner*—Ronald H. Lazarus

*Attorney, Agent, or Firm*—Curtis, Morris & Safford

[57] ABSTRACT

A method and apparatus for utilizing both a liquid fuel and a gaseous fuel with a minimum change in a standard internal combustion engine. The gaseous and liquid fuels are fed from separate fuel supplies with the flow of fuels being controlled in response to engine load so that at engine idle only gaseous fuel is supplied and combusted by the engine and both gaseous and liquid fuels are supplied and combusted when the engine is operating under load conditions.

12 Claims, 7 Drawing Figures

METHOD AND APPARATUS FOR UTILIZING GASEOUS AND LIQUID FUELS IN AN INTERNAL COMBUSTION ENGINE

BACKGROUND OF THE INVENTION

1. Field of the Invention

This invention relates to internal combustion engines and, more particularly, relates to a method and apparatus for utilizing both gaseous and liquid fuel in an internal combustion engine to increase fuel economy and engine efficiency while at the same time maintaining low levels of undesirable exhaust emissions.

2. Description of the Prior Art

As gasoline supplies become more scarce and costly and the need for fuel conservation becomes more readily apparent, alternate sources of fuels and methods of fuel conservation become more attractive, particularly for internal combustion engines for automotive use. Proposals for fuels other than gasoline for such engines have been made but use of alternate fuels require expensive modifications in internal combustion engine technology which are not practical to implement.

The present invention provides a method and apparatus which may be readily adapted to existing internal combustion engines and which provides a significant saving in gasoline consumption and lower cost during operation than that which can be attained using gasoline alone. The present invention uses a system which allows the burning of a gaseous fuel along with gasoline in internal combustion engines. Gaseous fuels which may be utilized with the present invention are such gaseous fuels as propane, natural gas, coal gas, butane, ethane, methane, water gas, producers gas, marsh gas, hydrogen or any other combustible gas. Many of these gases are available today or can become readily available in the near future as the technology for producing these gaseous fuels in high volume is already established. All of these gases can be compressed and stored and can be made readily available for efficient and effective distribution for automotive use.

A number of systems have been proposed for utilizing gaseous and liquid fuels in automotive engines but such prior proposed devices have involved more than a simple modification to a standard internal combustion engine or the use of complex manual controls. One device disclosed in U.S. Pat. No. 4,068,639 suggests the use of a gaseous fuel such as propane but requires use of a separate gaseous fuel reservoir and manual controls. Another prior art device, shown in U.S. Pat. No. 3,753,424, injects a gaseous fuel only at load conditions of the engine but this device is operable only with a fuel injection device and not with the standard carburetor most prevalent in internal combustion engines. A still further prior art device is that shown in U.S. Pat. No. 3,718,000 which teaches using a dual system to enable the operator of the vehicle to switch from either liquid fuel to gaseous fuel. This system does not teach or suggest use of both gaseous and liquid fuels at the same time. A similar system is also shown in U.S. Pat. Nos. 2,381,304 and 3,659,574. Another prior art system is shown in U.S. Pat. No. 2,339,988 which provides two carburetors, one for liquid fuel and the other for gaseous fuel. It has also been long known in the art that an internal combustion engine can run on a gaseous fuel such as propane alone and such a propane fuel engine is shown in U.S. Pat. No. 2,675,793.

None of these prior art devices use the system of the present invention wherein both gaseous and liquid fuels are used at the same time in an internal combustion engine which needs to be modified only slightly to incorporate the system of the present invention.

OBJECTS AND SUMMARY OF THE INVENTION

Accordingly, it is an object of the present invention to provide a method and apparatus for combusting both liquid and gaseous fuel in an automotive internal combustion engine while increasing the effectiveness and efficiency of both fuels.

It is another object of the present invention to provide a method and apparatus for utilizing both gaseous and liquid fuels in an internal combustion engine and providing a control element to feed only the gaseous fuel while the engine is operating at no-load conditions and both gaseous and liquid fuels while the engine is operating under load conditions.

It is a still further object of the present invention to provide a method and apparatus for combusting both liquid and gaseous fuels in an internal combustion engine without requiring extensive modifications to standard internal combustion engines designed for operation with liquid fuels only.

In accordance with a preferred embodiment of the present invention a source of gaseous fuel is provided through a regulator to the intake manifold of a standard internal combustion engine. A control panel controlled by some measurable parameter of the internal combustion engine directs only the gaseous fuel to the manifold for combustion while the engine is at idle and directs both liquid fuel to the carburetor and gaseous fuel to the manifold under engine load conditions.

These and other objects, features and advantages of the present invention will become more readily apparent in the following detailed description of an illustrative embodiment which is to be read in conjunction with the accompanying drawings.

Figure 1:
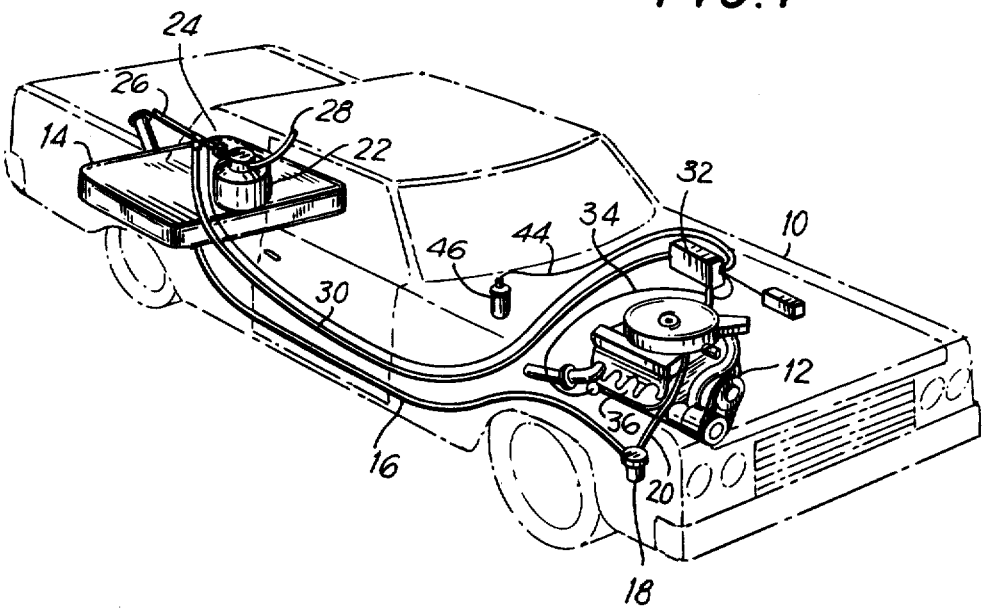
FIG. 1 is an overall perspective view showing the general orientation for using the present invention in connection with an internal combustion engine in an automobile.

With reference to the drawings, and initially FIG. 1, there is shown an automobile 10 having an internal combustion engine 12, a gasoline tank 14 with a fuel line 16 to a fuel pump 18 to pump gasoline through a gasoline feed line 20 to the engine carburetor (not shown in FIG. 1). These are all elements found in a standard gasoline powered internal combustion engine for automotive use. According to the present invention a gaseous fuel tank or reservoir 22 is also provided, as shown in FIG. 1 located in the trunk 24 of the vehicle, and includes a gaseous fuel fill line 26, a gaseous fuel atmospheric vent line 28, a gaseous fuel supply line 30 to a control box assembly 32 and a gaseous fuel feed line 34 to the intake manifold 36 of the internal combustion engine 12.

Figure 2:
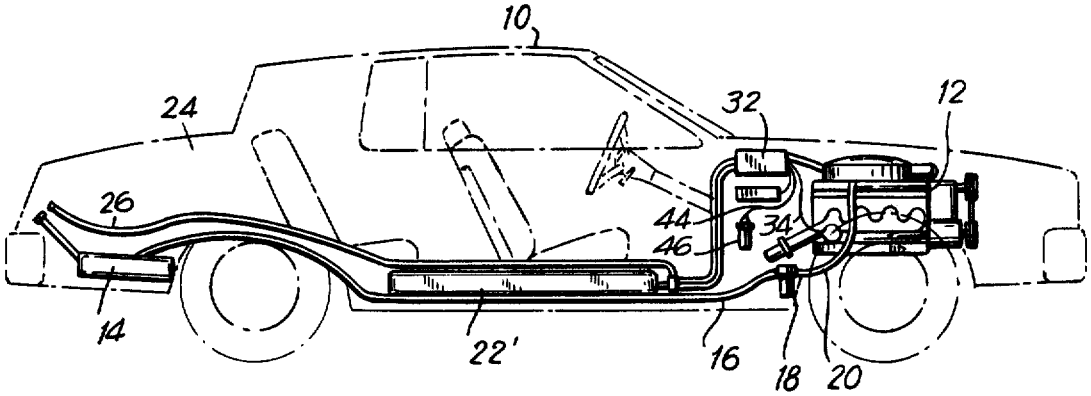
FIG. 2 is an elevational view showing an alternate location for the gaseous fuel tank in an automotive application.

Reference is now made to FIG. 2 which shows the same basic elements illustrated in FIG. 1 with an alternate location for the gaseous fuel tank 22' beneath the passenger compartment. In all other respects the embodiment of the invention shown in FIG. 2 is the same as that shown in FIG. 1 and like reference numerals are utilized in FIG. 2.

Figure 3:
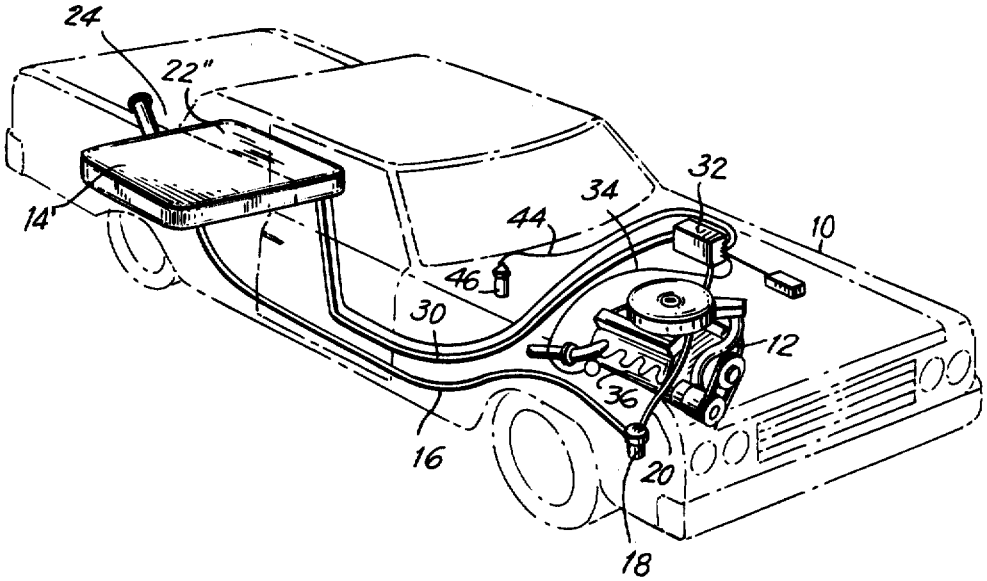
FIG. 3 is an overall perspective view similar to FIG. 1 showing another arrangement for the gaseous fuel tank in an automotive application.

As seen in FIG. 3, where like parts are indicated by like reference numerals, still another arrangement for the fuel tanks is to provide gaseous fuel tank 22'' in the form of an extension to gasoline tank 14' so that it is located in the same place on the vehicle as a standard gasoline tank.

Figure 4:
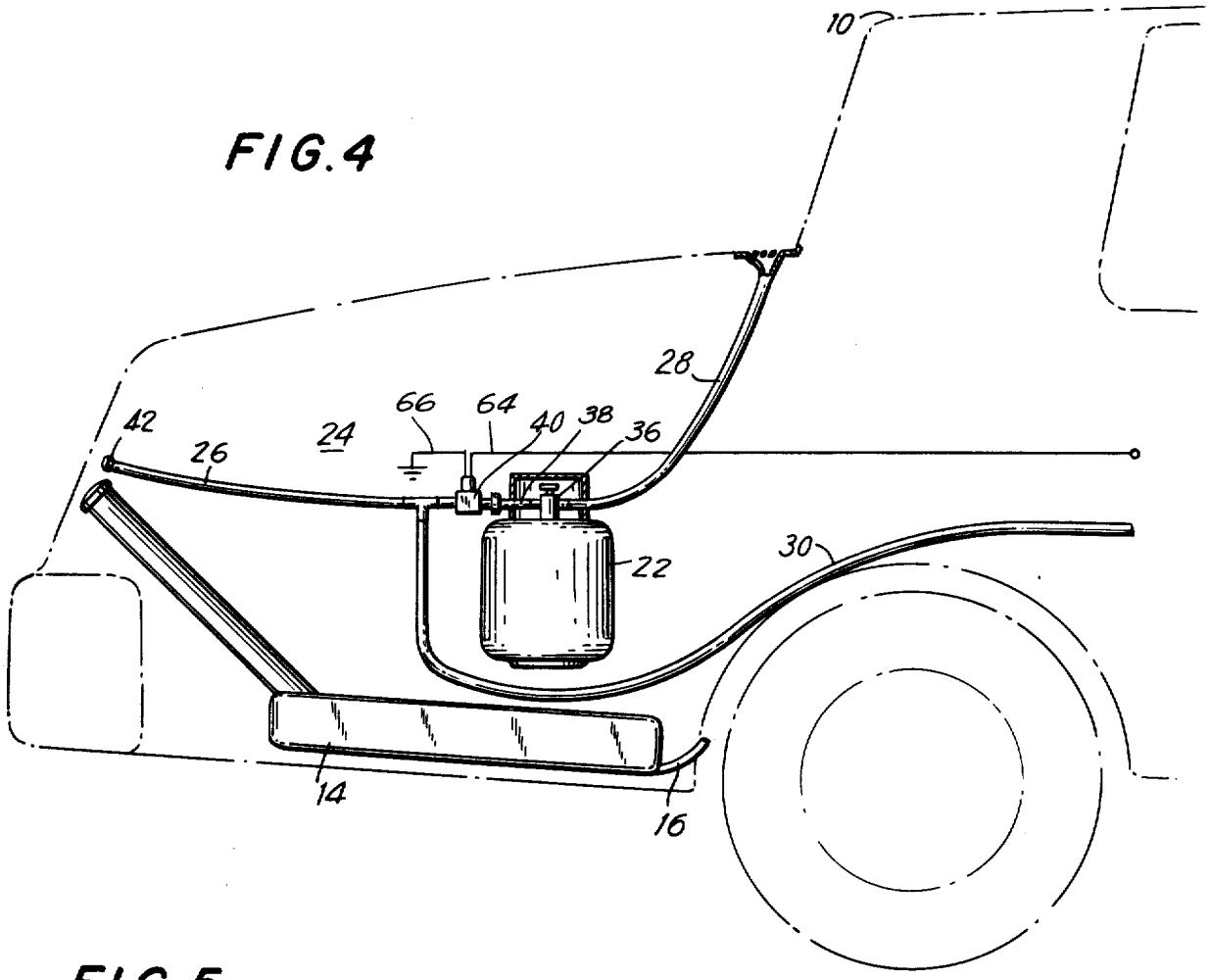
FIG. 4 is an enlarged elevational view showing the location of the gaseous fuel system in an automotive environment.

As best seen in FIG. 4, the gaseous fuel tank 22 mounted in the vehicle trunk 24 includes a discharge valve assembly 36 to which the vent line 28 is connected as well as a gaseous fuel feed line 38. A solenoid control valve 40 is provided connected to feed line 38 and solenoid valve 40 is operated by control assembly 32, as will be explained more fully hereinbelow. The gaseous fuel inlet line 26 includes a quick release valve connection 42 at its end to facilitate refueling of the gaseous fuel tank 22 and which remains in a normally closed position when refueling is not taking place. When gaseous fuel is being pumped into tank 22, solenoid valve 40 opens when the filling pressure is greater than the internal tank pressure and closes as soon as filling pressure is relieved. During operation of the vehicle, the control assembly 32 controls operation of the solenoid valve 40 to direct gaseous fuel through the gaseous fuel supply line 30. When the engine is shut off control assembly 32 shuts off solenoid valve 40 to preclude further flow of gaseous fuel from the reservoir 22.

Figure 5:
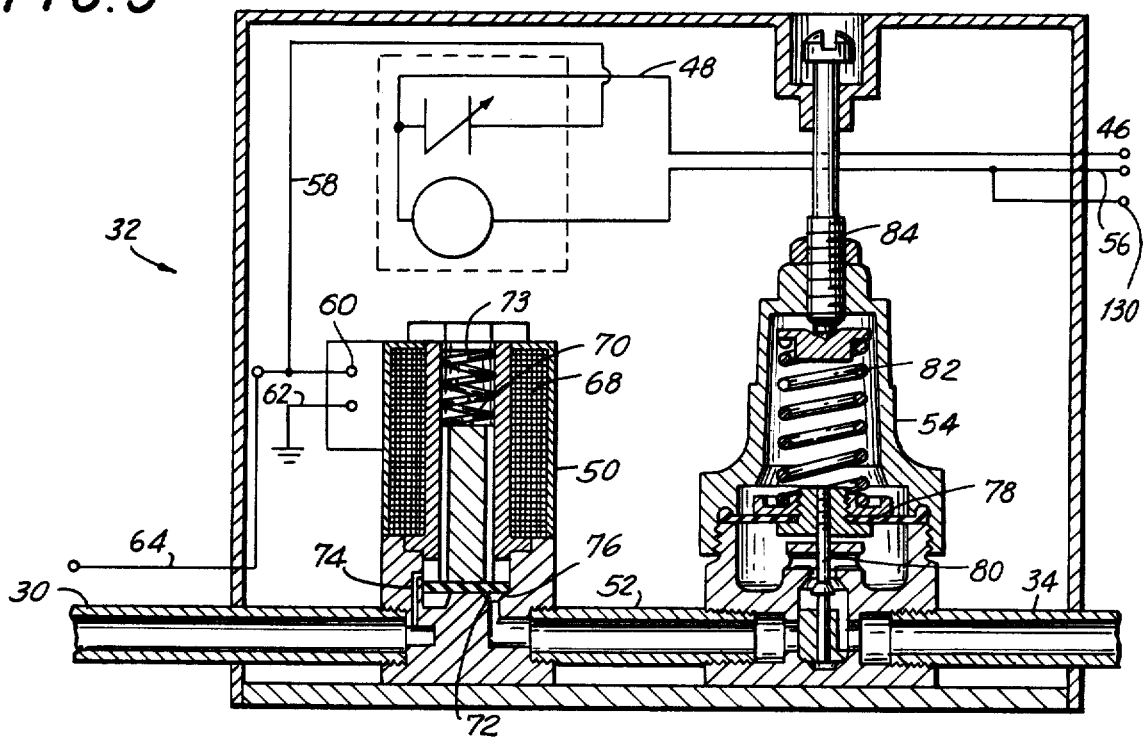
FIG. 5 is a schematic representation of the control system for the present invention.

Reference is now made to FIG. 5 as well for a description of the control function of assembly 32. Control assembly 32 operates, as most auto accessories, from the automobile electrical system. Accordingly, a positive lead 44 (see FIG. 1) is obtained from the coil or electronic ignition control 46 and is directed to a twelve volt relay circuit 48 within the control assembly. Relay circuit 48 operates a gaseous fuel control solenoid 50 to control the flow of gaseous fuel from the gaseous fuel supply line 30 through solenoid 50 to a gas exit line 52 feeding into a regulator valve 54 which controls the flow of the gaseous fuel to gas feed line 34 to the engine manifold.

Since solenoid 50 along with solenoid 40 controls the flow of gaseous fuel from the gaseous fuel tank 22, it is imperative that the control solenoids 40 and 50 remain closed during any period when the engine 12 is shut off, except when tank 22 is being filled when gas flows through solenoid valve 40. As noted above, in this instance solenoid 40 opens due to the pressure exerted on the valve stem which overrides the pressure of the valve spring, thus permitting refueling. However, in the case of solenoid 50 the increased pressure closes the solenoid stalling the engine. Thus, the vehicle must be turned off when refueling is taking place. Accordingly, an operating engine parameter may be selected to initiate opening of the control solenoids 40 and 50. Any operating parameter may be used, for example, the ignition switch or engine oil pressure indicator. Preferably, gaseous fuel should not be fed unless the engine is operating so that an operating engine parameter such as the oil pressure indicator is preferably used. Accordingly, a line 56 from the oil pressure indicator may be used to feed relay 48 to operate solenoids 40 and 50. Since the oil pressure indicator operates only when the engine is running, solenoids 40 and 50 will be operable only when the engine is running. Thus, relay 48 is not activated when the engine is running. When the ignition switch is turned on, relay 48 is activated due to the grounding of the oil pressure switch. As soon as oil pressure begins to build up, the grounded circuit opens turning off relay coil 48. The time it takes relay coil 48 to operate allows solenoid 50 to open to provide a choking amount of gaseous fuel to flow to start the engine. The length of this time may be controlled by a simple electrical timing of relay coil 48. Accordingly, lead 56 from the oil pressure indicator switch is fed to relay 48 and a line 58 from relay 48 is connected to one side 60 of solenoid 50 with the other lead 62 being grounded. In like manner relay 48 is operably connected to one side of solenoid 40 through a lead 64 with the other side 66 of the solenoid 40 also being grounded. During normal engine running, solenoids 40 and 50 are open to permit gaseous fuel flow to the engine.

Solenoid 50, as shown in FIG. 5, is in its closed position and includes a coil 68 terminating in respective leads 60 and 62 about a plunger 70 having a seal member 72 at its free end. A coil spring member 73 is also provided to urge plunger 70 to its normally closed position. In the closed position illustrated, seal 72 is below gaseous fuel inlet port 74 connected to gaseous fuel supply line 30 and is firmly seated against a gaseous fuel outlet port 76 connected to gaseous fuel feed line 52. With this arrangement an increased gaseous fuel pressure in fuel supply line 30, as would result in gaseous refueling, will act to seat seal 72 more firmly against port 76 to preclude fuel flow to the engine. Upon excitation of solenoid 50, plunger 70 retracts lifting seal 72 above inlet port 74 to allow gaseous fuel flow from port 74 to port 76 and into feed supply line 52. Solenoid 40 operates in a similar manner upon its excitation.

With solenoids 40 and 50 in the open condition, gaseous fuel flows from fuel reservoir 22 through gaseous fuel feed line 52 into gas regulator 54. Regulator 54 includes a diaphragm 78 which controls the opening and closing of a cartridge valve 80. A coil spring 82 has one end bearing against the diaphragm 78 and a regulating screw 84 bears against the other end of spring 82. Regulator 54 operates as a standard gas regulator in that valve 80 opens when the gas pressure equals the pressure of spring 82 on diaphragm 78. The spring pressure against diaphragm 78 can be adjusted by the adjusting screw 84 so that cartridge valve 80 opens when the desired gas pressure is reached. Thus, gas flows through gas regulator 54 and is fed by gaseous fuel feed line 34 to manifold 36 of engine 12. At idle, the engine manifold vacuum pressure is at is maximum, i.e. maximum negative pressure, thus drawing gas from regulator 54. As the engine load is increased, the vacuum pressure decreases slightly. However, the volume of displacement through the manifold increases thus entraining more gas through a venturi effect and regulator 54 allows a greater flow of gas than exists at engine idle conditions.

Thus regulator 54 acts as an automatic accelerator control.

Figure 6:
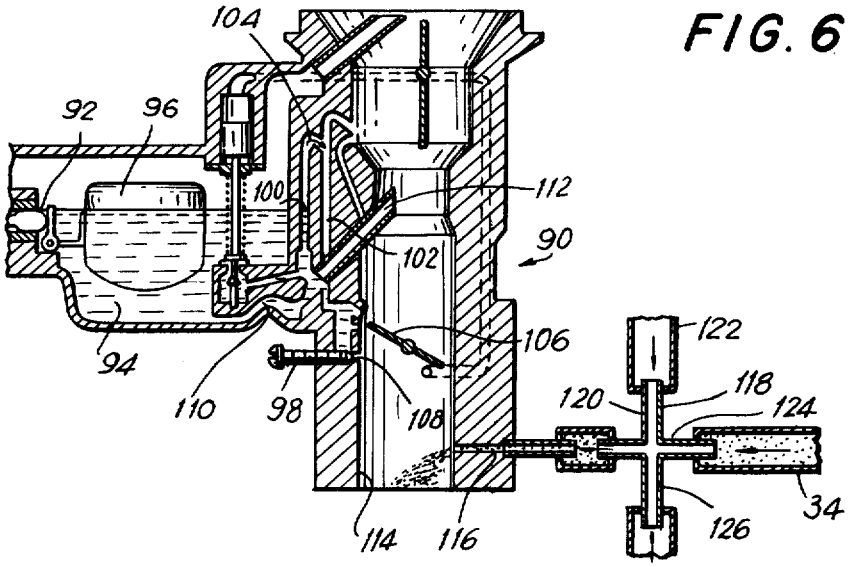
FIG. 6 is a sectional view showing the engine carburetor and manifold assembly in an idle condition.
Figure 7:
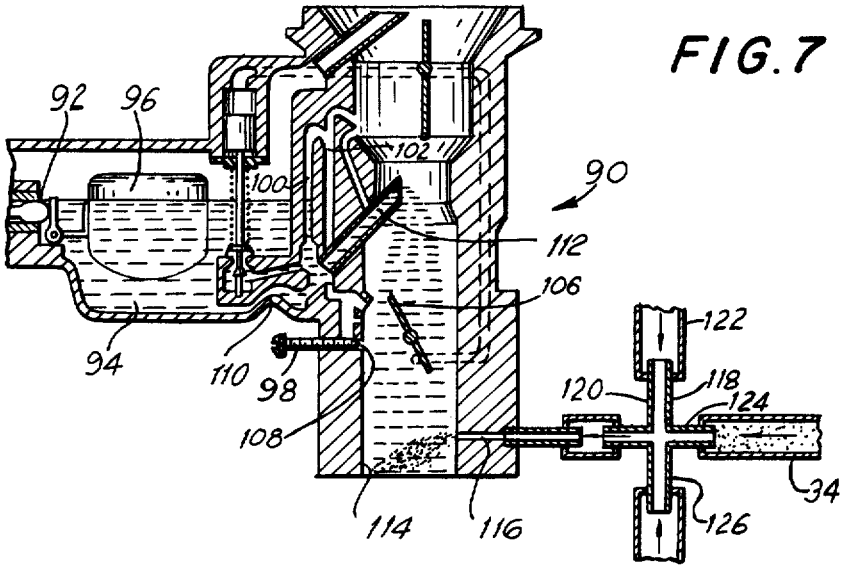
FIG. 7 is a view similar to FIG. 6 showing the engine condition at a load state.

With reference to FIGS. 6 and 7 as well, there is schematically represented a standard carburetor as used on a gasoline internal combustion engine and showing the connection of the gaseous fuel supply source according to the present invention. Standard carburetor 90 includes a gasoline inlet line 92 which delivers gasoline to a fuel reservoir 94 with the delivery controlled by carburetor float valve 96. The carburetor also includes an idle adjustment screw 98 whose position is adjusted to adjust the amount of gasoline delivered to the intake manifold during normal idle conditions of the engine. In a standard internal combustion engine during idle, gasoline flows up the idling gas supply tube 100 down the idle gas feed tube 102 in the direction indicated by the arrow 104 to be discharged below the carburetor throttle valve 106 through the idle gasoline supply port 108. In standard engines, the idling control screw 98 is adjusted to permit the desired flow of gasoline at engine idling speeds through the discharge port 108. According to the present invention the idle adjustment screw 98 is advanced fully to completely seal idling supply port 108 so that no gasoline is delivered to the intake manifold of the engine during engine idling.

When the engine is under load condition, e.g. when the accelerator pedal is depressed, gasoline is fed from the fuel reservoir 94 through the main metering tube 110 to the main fuel discharge nozzle 112 past the throttle valve 106 to become vaporized in the intake manifold 114 for distribution to the combustion cylinders of the engine.

Most internal combustion engines in automotive use have a relief port 116 in the engine manifold leading to a charcoal canister for gasoline vapor or to the valve taper cover. According to the present invention a T-assembly 118 is provided connected to the gasoline vapor port 116. The T-assembly 118 includes a branch 120 which is connected to the tube 122 removed from the intake manifold, a branch 124 to which is connected the gaseous fuel feed line 34 and a branch 126 for an air intake orifice to mix air with the gaseous fuel supply. T-assembly 118 is suitably connected to port 116 in the engine intake manifold so that gaseous fuel and air are supplied directly into the intake manifold as shown in FIGS. 6 and 7. The air intake 126 is important for proper air flow mixing ratios and it is important that the size of the air intake is selected to minimize undue expansion of the gaseous fuel.

In operation, when the ignition is turned on to begin engine start, solenoid valves 40 and 50 open due to the time delay of relay coil 48 to allow a choking amount of gaseous fuel to enter the intake manifold of the engine, as shown in FIG. 6. The solenoids then close and remain closed until the engine is running. As soon as oil pressure increases solenoids 40 and 50 once again open to supply gaseous fuel to the intake manifold and relay coil 48 is deactivated. According to the present invention, during engine operation if the accelerator pedal is not depressed, only gaseous fuel flows to the engine manifold. For starting it may be necessary to depress the accelerator to pump gasoline into the carburetor for initial start. But once started, only gaseous fuel is supplied and combusted by the engine at no-load idle. With a load placed on the engine by activating the throttle, gasoline is supplied as well and both gaseous fuel and gasoline are supplied to the engine manifold. Because the engine manifold works under a slight vacuum pressure the supply of gaseous fuel, properly regulated and adjusted by the gas regulator 54, flows into the engine manifold. At increasing loads, the manifold fold vacuum pressure also increases thus drawing additional amounts of gaseous fuel into the manifold along with additional amounts of gasoline to supply greater amounts of fuel to accommodate the increased engine load. Thus throttle regulation of the gaseous fuel is automatically accomplished by increased manifold vacuum pressures without requiring any additional throttling mechanisms for the supply of gaseous fuel. By this is meant that added liquid fuel, i.e. gasoline, will cause an increase in the combustion rate in the cylinders and, thus, cause a greater demand for air to mix with the gasoline for combustion. The increase in combustion causes an increase in the cycle firings of the cylinders so that there is a greater number of firings per time frame than is the case where less gasoline is fed. This increase in firings causes an increase in the volume displacement in the cylinders per time frame resulting in an increased demand for air. The increased air demand also increases the gaseous fuel flow. When the engine is at a desired speed the gaseous fuel will continue to flow along with the increased air supply to maintain the engine at its increased firings per time frame. The metering of gasoline and air from the carburetor must be reduced and in some cases stopped altogether. Thus the engine draws all or part of the cylinder displacement volume from the gaseous fuel system. The gaseous fuel and air mixture will continue to flow as long as there is a cylinder volume displacement. Only friction and increased load demand can cause deacceleration at which time the liquid fuel carburetor valving must be reactivated to maintain the desired speed or increased acceleration. Due to the speed of the engine the gaseous fuel and air mixture will flow at a greater quantity rate than is the case at idle or no load. This is due to the fact that the engine is operating at sufficient speed to cause an increased volume displacement in the cylinders which is greater than is the case at no-load.

A number of safety features may be included in the connection to control assembly 32 to insure that adequate safety features are incorporated to the gaseous fuel flow. For example, a gaseous fuel leak detection system may be incorporated to detect any gaseous fuel leaks in the system to connect a ground connection 130 to interrupt the electrical supply to shut solenoids 40 and 50 when any gas leak is detected. In like manner, a position sensing device may be incorporated in control assembly 32 to sense deviations in the horizontal position of the automobile so that if the automobile is turned over in an accident, the position detecting device also connects ground connection 130 to disconnect the electrical supply and shut off gaseous fuel supply through solenoids 40 and 50. In like manner, an impact detection device may also be incorporated which would also operate a ground to connection 130 to shut off gaseous fuel supply upon detection of a sudden impact in the event of an accident to again connect the electrical supply to relay 48 and shut off the gaseous fuel supply.

It is thus seen that the present invention provides a method and apparatus for incorporating a gaseous fuel supply for use with an automobile internal combustion engine and which may be readily incorporated in existing automobiles without requiring extensive modifications or changes in basic internal combustion engine technology.

A distinct advantage of the present invention is the fact that the modifications to existing internal combustion engines to use the invention are slight. The drawbacks to many of the alternate fuel systems for use in existing internal combustion engines proposed heretofore are the necessity for substantial engine modifications to obtain efficient and economical operation. As an example, many such prior art systems require modifications such as increasing the engine compression ratios, reducing the spark plug gap, changing the exhaust valve seats, cooling the intake manifold, revising ignition timing and providing additional lubrication to the working parts. None of these modifications are necessary with the present invention. Additionally, in situations where a supply of gaseous fuel is not readily available when the gaseous fuel supply is exhausted, any vehicle utilizing the present invention can continue to function on the gasoline fuel only as all that is required, in such an event, is to readjust the carburetor idle adjustment screw to permit normal flow of gasoline through the carburetor at engine idle.

With the method and apparatus of the present invention and utilizing gaseous fuels such as propane and natural gas in conjunction with gasoline it has been found that in four, six and eight cylinder test vehicles gasoline efficiency was increased signigicantly with significant savings in cost. The table below shows representative fuel and cost savings obtained in testing the present invention in representative four, six and eight cylinder vehicles.

APPROXIMATE COST OF GASOLINE, GASOLINE + PROPANE, GASOLINE + NATURAL GAS

| | 8 CYLINDER VEHICLE | 6 CYLINDER VEHICLE | 4 CYLINDER VEHICLE |
|---|---|---|---|
| Gasoline as Fuel at $1.30 gal. | 9 mi. per gal.<br>14.4¢ per mile | 15.6 mi. per gal.<br>8.3¢ per mile | 18 mi. per gal.<br>7.2¢ per mile |
| FUEL (Gasoline + Propane) | | | |
| Gasoline | 15 mi. per gal. | 26 mi. per gal. | 30 mi. per gal. |
| Propane | 7.5 mi. per lb. | 11.5 mi. per lb. | 12.0 mi. per lb. |
| Gasoline at $1.30 per gal. | 8.6¢ per mi. | 5.0¢ per mi. | 4.3¢ per mi. |
| Propane at $.26 per lb. | 3.4¢ per mi. | 2.2¢ per mi. | 2.1¢ per mi. |
| TOTAL | 12.2¢ per mi. | 7.2¢ per mi. | 6.4¢ per mi. |
| % SAVING IN COST OF FUEL OVER GASOLINE ALONE | 16.6% | 13.2% | 11.1% |
| FUEL (Gasoline & Natural Gas) | | | |
| Gasoline | 15 mpg | 26 mpg | 30 mpg |
| Natural Gas | 7.5 mi/lb. | 11.5 mi/lb. | 12. mi/lb. |
| Gasoline at $1.30 per gal. | 8.6¢ per mi. | 5.0¢ per mi. | 4.3¢ per mi. |
| Natural Gas at .09 per lb. | 1.2¢ per mi. | .79¢ per mi. | .75¢ per mi. |
| TOTAL | 9.8¢ per mi. | 5.79¢ per mi. | 5.05¢ per mi. |
| % SAVING IN COST OF FUEL OVER GASOLINE ALONE | 32% | 30.2% | 29.8% |
| % SAVING IN GASOLINE | 66.6% | 66.6% | 66.6% |

It is thus seen that using propane and/or natural gas as the gaseous fuel with the present invention on vehicles with four, six and eight cylinders resulted in significant gasoline savings averaging 66.6% and significant cost savings based on present costs of the available fuels.

It is also believed that more complete combustion of the gasoline occurs during operation as the injection of the gaseous fuel into the engine manifold entrains the vaporizing gasoline to insure more rapid vaporization. It is also believed that the increased pressure in the manifold due to the entry of gaseous fuel under pressure provides for a more rapid and even distribution of fuel to the engine cylinders. The net result is a more efficient combustion to aid in overall engine efficiency while minimizing the exhaust of unburned hydrocarbons. It has been found that carbon monoxide emissions were reduced by about 50% when both gaseous fuel and gasoline were used as compared to the same vehicle operating on gasoline alone. Significant reductions in nitrous oxide emissions were also observed.

What is claimed is:

1. A method for utilizing both gaseous and liquid fuels in a standard internal combustion engine utilizing a carburetor having a throttle valve therein for cutting off the supply of air and liquid fuel to the carburetor while the engine is in a no-load idle operating state, said method comprising:

supplying liquid fuel and air to the engine carburetor, supplying gaseous fuel from a separate gaseous fuel reservoir at regulated pressure stored under substantially high pressure and released from the reservoir at a lower regulated pressure mixing said gaseous fuel with air from a supply independent of the liquid fuel air supply, and feeding the gaseous fuel and air mixture directly to the intake manifold of said internal combustion engine at a point between the carburetor throttle valve and the manifold, controlling the flow of liquid fuel from said carburetor to said engine manifold to preclude feeding of liquid fuel to said manifold while the engine is in a no-load idling operating state, supplying only the gaseous fuel and air mixture to said engine manifold at a controlled rate while said engine is in said no-load idling state, and feeding increasing quantities of both gaseous and liquid fuels to said manifold responsive to increasing engine loads, the feeding of gaseous fuel being controlled by the manifold vacuum, volume displacement of the engine cylinders.

2. The method as defined in claim 1 including the step of controlling the flow of gaseous fuel from said gaseous fuel reservoir in response to a sensed operating parameter of said engine.

3. The method as defined in claim 2 wherein said sensed operating parameter of said engine is an indication of engine oil pressure.

4. The method as defined in claim 1 including the step of providing a regulator device to control the rate of flow of gaseous fuel to increase the rate of flow responsive to an increase in engine load as reflected by an increase in the manifold vacuum pressure, volume displacement of the engine cylinders.

5. An apparatus for utilizing both a liquid and gaseous fuel in an internal combustion engine having at least one carburetor and one intake manifold system and a liquid fuel reservoir operatively connected to said carburetor to supply liquid fuel for distribution by said carburetor to said intake manifold said carbureator having a throttle valve therein for controlling the flow of air and liquid fuel to the manifold system, said apparatus comprising:

a gaseous fuel reservoir operatively connected through a gaseous fuel and air mixer to the intake manifold to supply gaseous fuel by direct flow to said manifold, said mixer having an opening to the atmosphere to supply a separate supply of air independent of the carburetor for mixing with the gaseous fuel flowing to the manifold the air and gaseous fuel mixture entering the manifold between the manifold and the throttle valve, means to control the supply of both liquid and gaseous fuels to said intake manifold and to close the throttle valve and to supply only gaseous fuel to the engine at no-load engine idle conditions and to supply both gaseous and liquid fuels to the engine at load conditions, said means including the control of gaseous fuel being controlled by the manifold vacuum, volume displacement of the engine cylinders.

6. The apparatus as defined in claim 5 wherein said means to control the supply of gaseous fuel to said intake manifold includes an opened and closed valve means to control the flow of gaseous fuel from said gaseous fuel reservoir to said intake manifold.

7. The apparatus as defined in claim 6 wherein said valve means is selectively moved from its said closed position to its said open position responsive to a sensed operating parameter of said engine.

8. The apparatus as defined in claim 7 including means to sense changes in the oil pressure of said engine and wherein said sensed change in engine oil pressure is said sensed engine operating parameter.

9. The apparatus as defined in claim 6 wherein said control assembly includes means responsive to a warning detector means to close said valve means to preclude flow of gaseous fuel from said gaseous fuel reservoir to said engine manifold responsive to a sensed detection of said warning detector means.

10. The apparatus as defined in claim 9 wherein said detector means is a gaseous fuel leak detector.

11. The apparatus as defined in claim 9 wherein said detector means is an impact detector means.

12. The apparatus as defined in claim 9 wherein said detector means is a position detector means.

* * * * *